United States Patent [19]

Kuss

[11] 3,969,862

[45] July 20, 1976

[54] BUILDING CONSTRUCTION AND METHOD

[76] Inventor: Robert Kuss, c/o Production Specialties, Inc., 1020 Ford St., West Conshohocken, Pa. 19428

[22] Filed: Feb. 20, 1974

[21] Appl. No.: 444,085

Related U.S. Application Data

[62] Division of Ser. No. 171,896, Aug. 16, 1971, Pat. No. 3,807,100.

[52] U.S. Cl. ..... 52/404; 52/92;619

[51] Int. Cl.[2] ..... E04B 1/74

[58] Field of Search ..... 52/404, 406, 619, 17, 52/2; 160/40–43

[56] References Cited

UNITED STATES PATENTS

| | | | |
|---|---|---|---|
| 445,262 | 1/1891 | Kinnear | 52/619 |
| 1,596,890 | 8/1926 | Porbeck | 52/406 |
| 1,848,715 | 3/1932 | Hart et al. | 52/619 |
| 2,579,157 | 12/1951 | Price et al. | 52/619 |

*Primary Examiner*—J. Karl Bell

*Attorney, Agent, or Firm*—Seidel, Gonda & Goldhammer

[57] ABSTRACT

A collapsible building and a method for constructing the same in situ. The building is comprised of a plurality of separate elements. The elements include a foundation, columns, roof trusses, and side and roof panels. The columns and roof trusses include elongated portions which serve as the juncture for the panels. The panels define the inner and outer surfaces of the roof and sides of the building.

The method of constructing the building comprises the steps of setting the foundation, erecting the columns on the foundation, supporting the roof trusses on the columns, sliding roof and side panels into their positions, installing a ridge cap, and sealing the structure.

7 Claims, 13 Drawing Figures

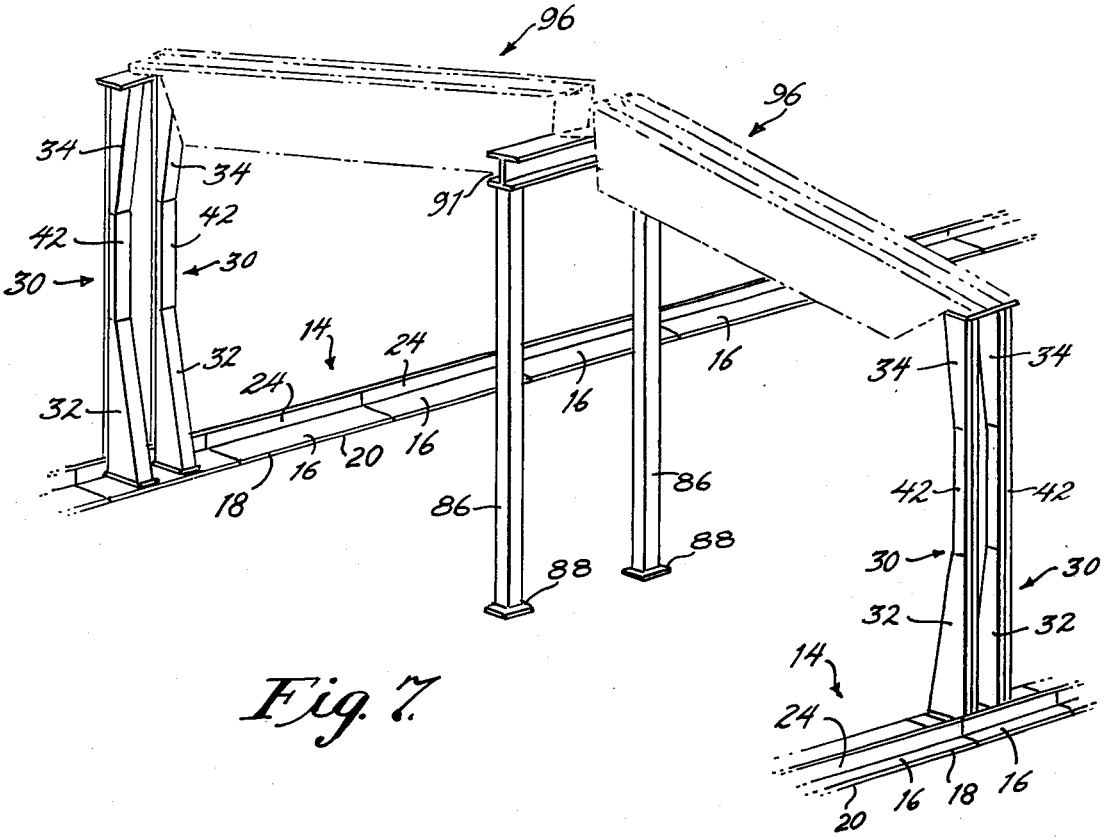
Fig. 7.
Fig. 11.
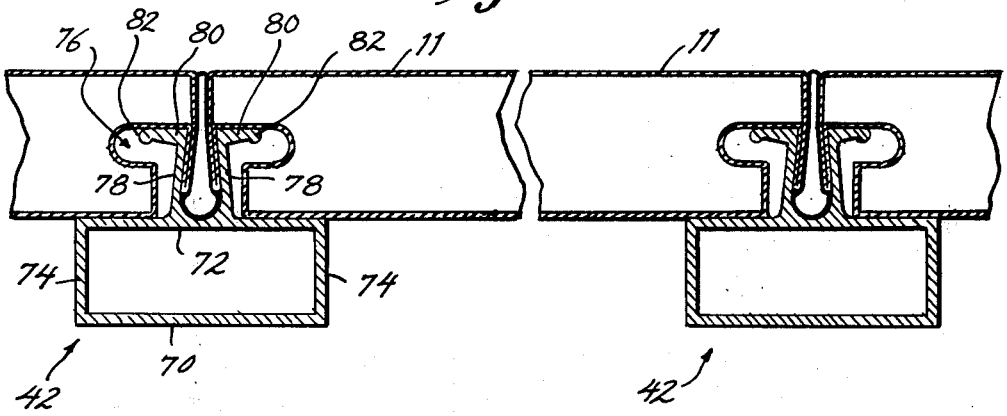

BUILDING CONSTRUCTION AND METHOD

This application is a division of my copending application Ser. No. 171,896, filed Aug. 16, 1971, now U.S. Pat. No. 3,807,100, entitled "Building Construction With Elongated Support Member And Interfitting Panels".

This invention relates to a collapsible building and method for constructing the same, and more particularly to a building construction and method relating to the use of prepared building elements which can be transported to the building site and there assembled into the building.

It is often desirable to construct a building, for use as either a dwelling or for storage which is to have a temporary life. Thus, such a building should preferably be constructed of materials that are readily obtainable and easy to assemble. Preferably, such a building should also be relatively easy to disassemble for use at a later time at a different site.

Advantageously, such a building could be designed in advance, with all of the elements comprising its construction assembled together at the building site so that a crew of relatively inexperienced and unskilled personnel could assemble it.

Such a building would have to be comprised of components which are light when taken individually, however, when assembled together to form a unitary building they must make a strong structure that is capable of withstanding heavy loads such as storage loads, snow loads, wind loads and the like. Additionally, the building must be impervious to moisture and should be relatively easy to insulate.

Thus, one aspect of the invention relates to a method forming a surface of a building or the like which comprises providing a plurality of elongated members defining generally outwardly facing channels, and placing them in generally spaced parallel relation with respect to eath other. Then, a plurality of members defining the surface to be constructed are provided. Each of the members have depending legs along opposite edges thereof which are arranged in overlying relation to the aforementioned channels so that the legs are received within the channels. Then, the legs are urged into close association with the side walls of the channels so that they are contacted thereby and held closely therewith so that the members define the surface.

Another aspect of the invention relates to a unique framing member which comprises an elongated platform which defines two outwardly projecting arms. On the platform are two upwardly and inwardly directed oppositely facing elongated walls, each of the walls having an outwardly extending arm at its free end.

Another aspect of the invention relates to a building construction comprising a panel having inner and outer walls. Each of the walls have depending legs which are in close contact with each other to form panel legs. The panels are connected to a channel in side by side relation with a depending leg on each panel received within said channel. Means are provided for urging the panel legs into close contact with the channels.

Another aspect of the invention relates to a frame for a collapsible building which comprises outer columns defining a perimeter and inner columns disposed linearly within the perimeter. Means are provided for interconnecting at least two of the inner columns. Roof trusses are provided for spanning between the inner columns and the interconnecting means to define a roof for the building and the roof trusses are provided with latching means for releasably connecting them with some of the inner and outer columns.

The invention also relates to a support for a collapsible building which comprises a foundation comprised of a plurality of separable members with an upwardly extending leg supported by the members.

Further, the invention also relates to a roof for a collapsible building which comprises a plurality of roof trusses which are supported at each of their ends. Each of the roof trusses includes an upwardly facing channel. Roofing members in the form of panels with depending legs are slidably received in each of the channels defining adjacent roof trusses. Means are provided to be positioned within the roof truss channels to hold the panels in fixed relation thereto.

Still another aspect of the invention relates to a side panel and roof panel construction for a collapsible building comprising a plurality of columns, each of which support one end of a roof truss and means for supporting the other end of each roof truss. The outwardly facing surfaces on the columns and the upwardly facing surfaces on the roof trusses define channel members which slidably receive the side panels and roof panels of a collapsible building.

Still further, this invention relates to a roof panel for a collapsible building which comprises an elongated open ended member with caps closing each of the ends. The caps are provided with hooking means for hooking onto an adjacent roof panel. One of the ends of the roof panel has an outwardly extending shingle.

Finally, the invention relates to a method of constructing a collapsible building comprising the steps of erecting a plurality of outer columns, providing means for supporting one end of a plurality of roof trusses, mounting elongated roof trusses so that they span between said columns and said means for supporting one end, and then sliding roof panels into engagement with said roof trusses and side panels into engagement with said columns so that said side panels constrain said roof panels on said trusses.

Accordingly, it is an object of this invention to provide a novel and unobvious method for constructing a collapsible building.

It is another object of this invention to provide a novel and unobvious collapsible building.

It is still another object of this invention to provide novel and unobvious elements which may be assembled to construct a collapsible building.

Other objects and advantages of the invention will be apparent from a detailed description of presently preferred forms thereof which will be described with respect to the attached drawings wherein.

Figure 1:
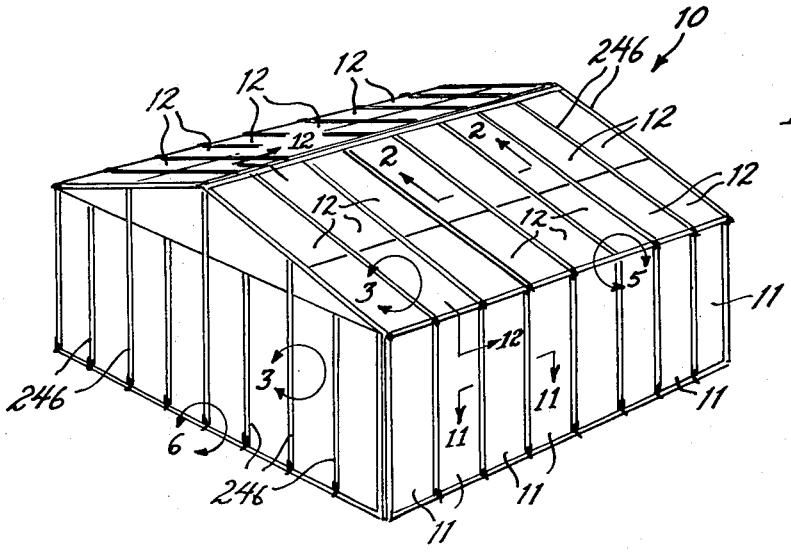
FIG. 1 is a perspective view of a collapsible building constructed in accordance with the present invention.
Figure 6:
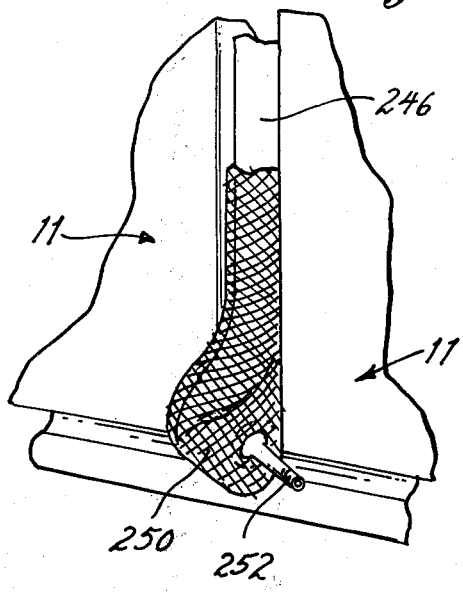
Figure 5:
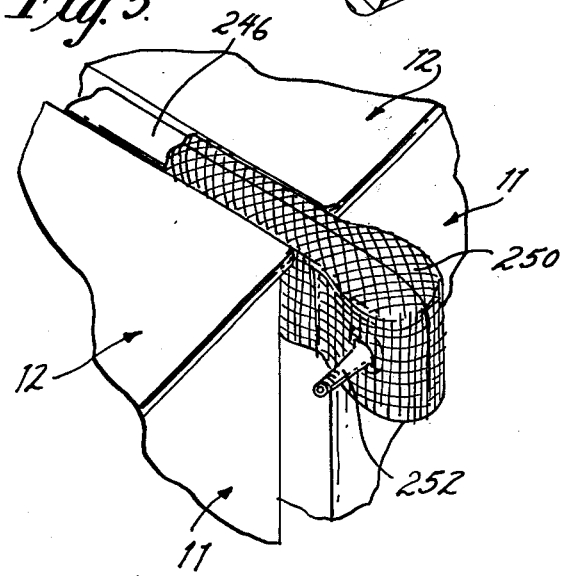

FIGS. 5 and 6 are views taken at details 5 and 6 on FIG. 1.

FIG. 7 is a perspective view of the portion of the framework of the collapsible building illustrated in FIG. 1.

Figure 8:
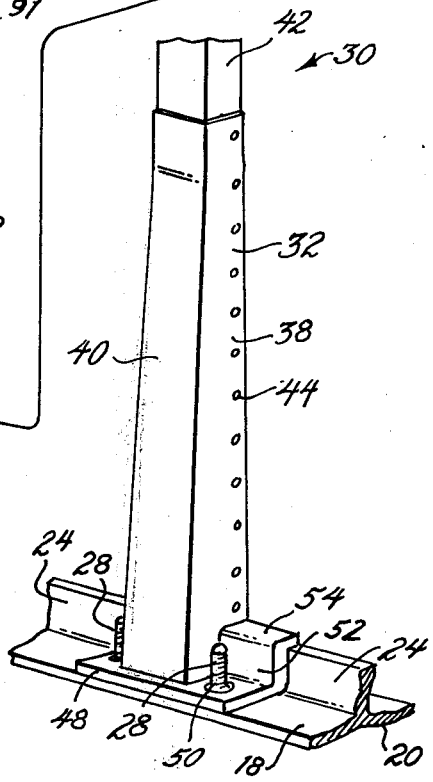

FIG. 8 is a perspective view of the base of one of the outer columns shown in FIG. 7.

Figure 9:
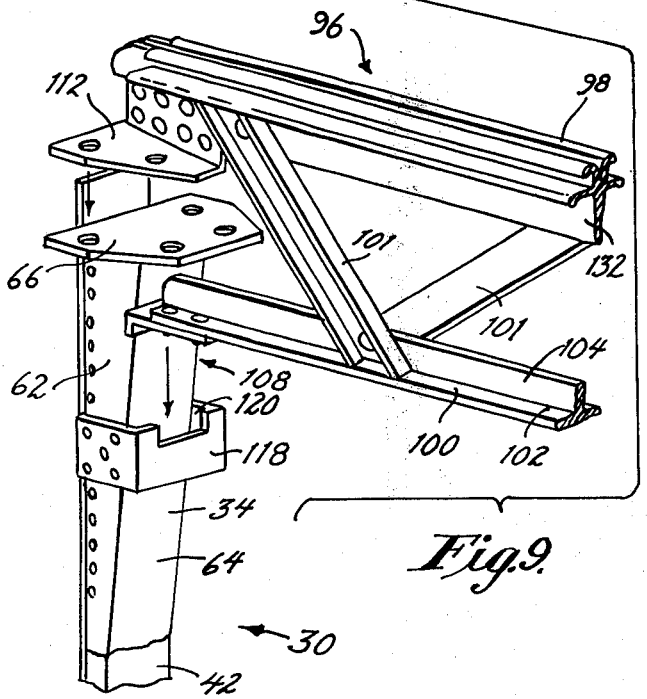

FIG. 9 is a perspective view of the upper portion of one of the outer columns illustrated in FIG. 7 and its manner of connection to the roof truss.

Figure 10:
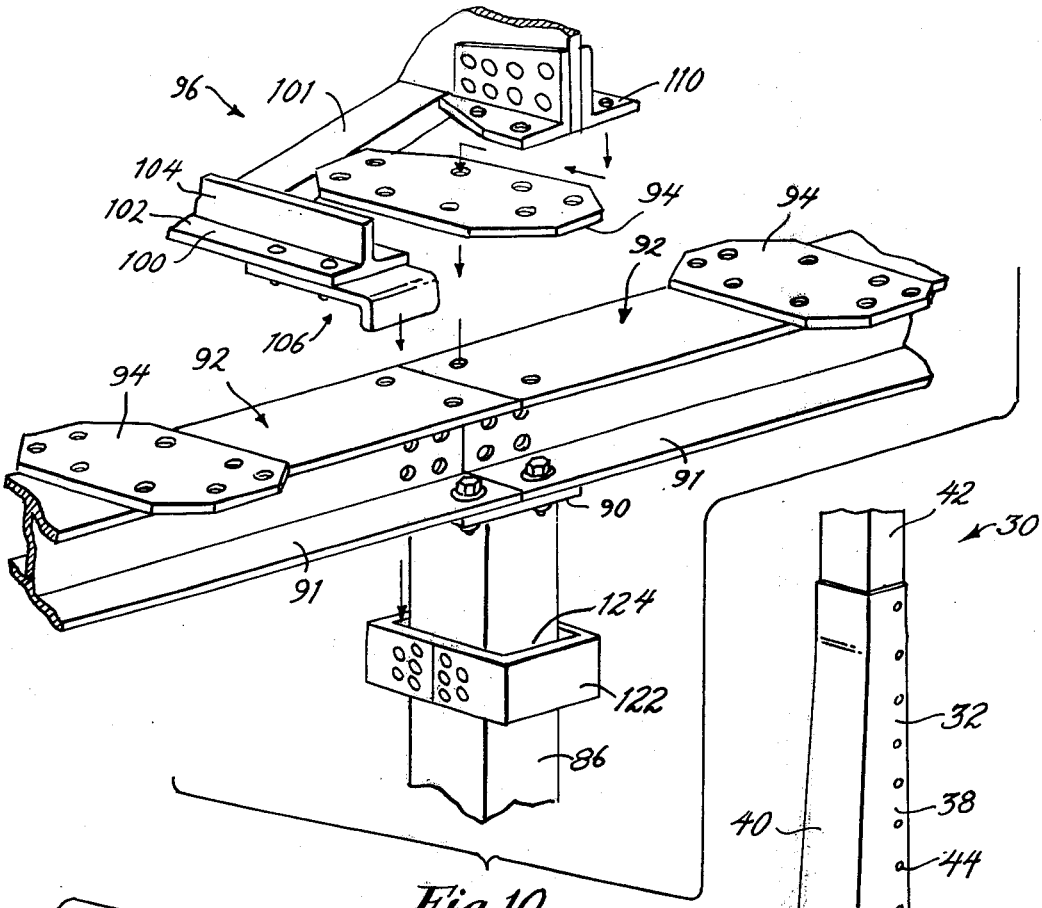

FIG. 10 is a perspective view of an inner column and a roof truss.

FIG. 11 is a sectional view taken on line 11—11 of FIG. 1.

Figure 12:
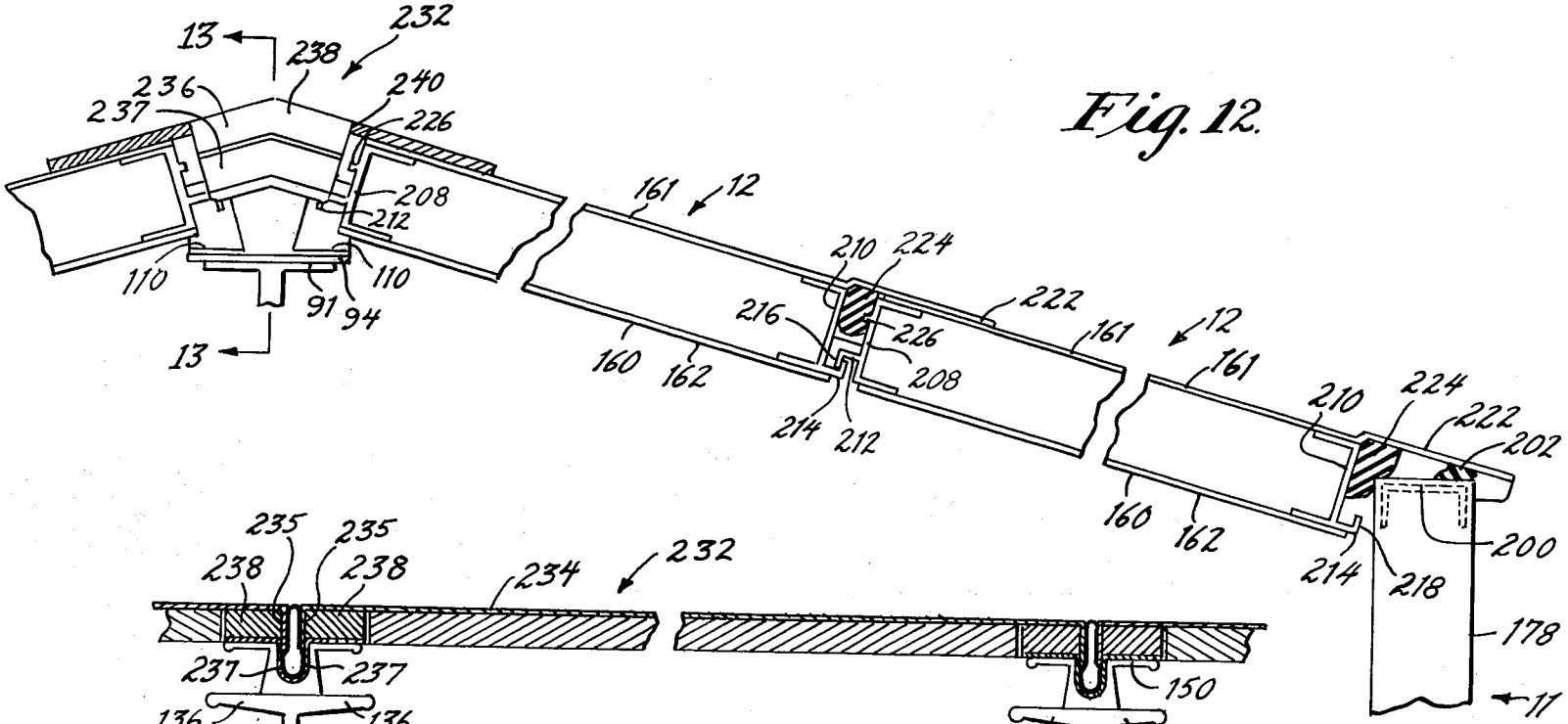

FIG. 12 is a sectional view taken along line 12—12 of FIG. 1.

Figure 13:
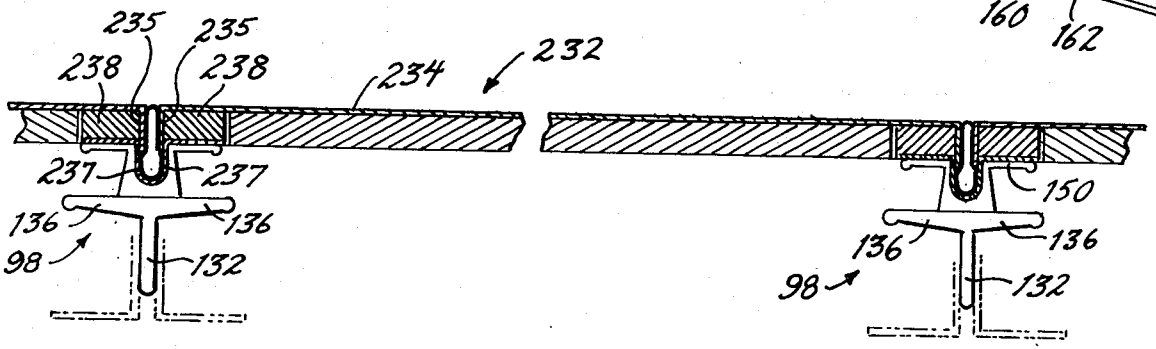

FIG. 13 is a sectional view taken along line 13—13 of FIG. 12.

Referring now to FIG. 1 for a detailed description of the present invention, a collapsible building 10 constructed in accordance therewith is illustrated. The collapsible building may comprise a plurality of walls with a roof overlying them. The walls and roof are formed from wall panels 11 and roof panels 12. It may include a floor or have a floor comprised of natural materials. All of its surfaces and its underlying framework may be constructed in accordance with the present method and apparatus.

As seen in FIGS. 7 and 8, the collapsible building is built on a foundation 14 which is comprised of a plurality of separate members 16. Each of the foundation members is generally T-shaped in cross section having a base 18 defining a downwardly facing flat surface 20 which is adapted to rest on the ground and an elongated upwardly extending leg 24 disposed longitudinally thereof. When the separable members 16 comprising the foundation are arranged to define a perimeter, all of the upwardly extending legs 24 are in alignment with respect to each other. When the foundation is laid, caulking or other sealing means may be interposed between surface 20 and the ground.

The corner members of the foundation (not shown), i.e. those which turn to form the ends of the building have angularly shaped elongated members so that each of the upstanding legs thereon lies in the plane of one of the walls of the building.

Each of the separable foundation members 16 may be provided with openings disposed at regular spaced intervals therealong. Threaded bolts 28 or other fasteners may be inserted through those openings in an upward direction. Alternatively, the bolts may be formed with the foundation members.

A plurality of outer columns 30 are mounted at regular intervals along the foundation. Each of the columns include a base 32 (FIG. 8) and an upper portion 34 (FIG. 9).

Each of the column bases 32 comprises two generally triangularly shaped side walls 38 in spaced parallel relation with respect to each other that are interconnected by a web or front wall 40. The front wall 40 slopes upwardly and rearwardly to follow the line of the side walls.

An elongated component 42 of each outer column is supported by the front and side walls of the base and may be held there by fasteners 44 such as rivets or bolts.

The bases 32 are supported at regular intervals along the foundation. Each of the bases has an anchoring collar 48 which is welded or otherwise fastened to the base. The anchoring collar comprises a flat plate 50 with a plurality of openings for receiving the upwardly directed bolts 28. Each flat plate 50 includes an upwardly directed flange 52 which bears against upwardly extending leg 24 and an overhanging lip 54 resting on the edge of leg 24.

As can best be seen in FIG. 8, when anchoring collar 48 is bolted to the foundation members 16, the base 30 is held securely against upwardly extending leg 24.

The bases 32 form the lower portion of outer columns 30 (FIG. 7). The intermediate portion 42 of an outer column is generally rectangular in cross section. The upper portion 34 of the outer column, best seen in FIG. 9, comprises two upwardly and forwardly directed generally triangular side walls 62 which are interconnected by a front wall 64. The front wall slopes upwardly and forwardly. An outer support surface 66 defined by a horizontally disposed plate is supported by upper portion 34. The upper portion and base of the outer columns are connected by elongated component 42. Component 42 is rectangular in cross section (FIG. 11) and comprises a front wall 70, a rear wall 72 and side walls 74.

Each of the rear walls 72 is provided with a centrally positioned, outwardly facing generally channel-like member 76 which comprises two outwardly directed and generally converging spaced side walls 78. Each of the side walls 78 supports an elongated outwardly directed upper arm 80 at its free end. The ends of the upper arms 80 are provided with enlarged bulbous end portions 82.

As explained above, the outer columns are arranged at regular spaced intervals along the perimeter of the building. Thus, the channel-like members 76 function as joints between adjacent side panels 11 in a manner which will be described below.

Referring to FIGS. 7 and 10, a plurality of inner columns 86 are shown arranged in regularly spaced linear relation within the perimeter of the building. The inner columns 86 support the central portion of the building roof. Each of the inner columns 86 is an elongated generally rectangular element having a base 88 which is supported on the ground. Its free end carries a plate 90. The plate may be bolted to two elongated beams 91 which are in end-to end relation to form an interconnection means 92 between adjacent columns 86. Thus, the juncture of adjacent interconnection means 92 is at the midpoint of aforementioned plates 90 and the plates are bolted thereto in order to perfect the connection.

Disposed at regular intervals along the interconnection means 92 are a plurality of inner support surfaces 94 which are formed by plates with bolt holes therein. The plates may be either welded, riveted or otherwise fastened to the interconnection means 92. Some of the plates may overlie the juncture of beams 92 and must be bolted thereto after the beams are installed.

It is to be appreciated that the distance between adjacent inner column members 86 may be substantially greater than the distance between adjacent outer column members (FIG. 7). Thus the inner support surfaces 94 serve as connection points for the roof trusses in a manner which will be described.

The roof trusses 96 can best be described by referring to FIGS. 7, 9 and 10. Each of the trusses is comprised of spaced elongated upper and lower members 98 and 100. The upper and lower elongated members may be held spaced from each other by a plurality of braces 101. In the alternative, other means may be used. However, bracing such as that illustrated has been proven to be satisfactory for the intended purposes of this device. The lower elongated member 100 is generally T-shaped and has a flat base 102 with an upstanding centrally disposed leg 104. Secured to the base 102 at its ends are inner and outer truss latching means which comprise downwardly depending hook members 106 and 108.

The upper elongated member 98 is comprised of an elongated generally channel-like member. Thus, when the trusses are supported to define the roof, the channel-like members serve as a plurality of regularly spaced joints for supporting roof panels in a manner which will be described.

The upper elongated members 98 support inner and outer reaction plates 110 and 112 at their opposite ends. The reaction plates may be angle members having horizontally disposed surfaces adapted to mate with the aforementioned inner support surfaces 94 and outer support surfaces 66 (FIGS. 9 and 10). The inner and outer support surfaces and their respective reaction plates may be bolted together or connected by any suitable releasable fastening means.

Both the outer columns 30 and the inner columns 86 are provided with inner and outer latching means. The inner latching means include a collar 122 which may be secured to the side walls of the inner columns 86 and which has its end walls spaced from the front and rear walls of those columns to define a recess 124 between the collar and is respective inner column.

In like manner, the outer latching means comprises a collar 118 which is secured to the side walls of the upper portion of the outer column so that it is spaced from the front wall 64 thereof to define a recess 120.

The aforementioned hook members 106 and 108 are adapted to be slidably and releasably received in recesses 120 and 124 when the reaction plates rest against the inner and outer support surfaces. Thus, the trusses may be arranged along the perimeter in regularly spaced relation and can be easily disassembled when desired.

As explained above, the upper elongated member on each of the truss sections defines a joint whereby a plurality of roof panels can be received and supported by adjacent truss sections.

To this extent, the upper elongated member 98 of each truss member includes a downwardly depending leg 132 which is connected to the lower elongated member 100.

Figure 2:
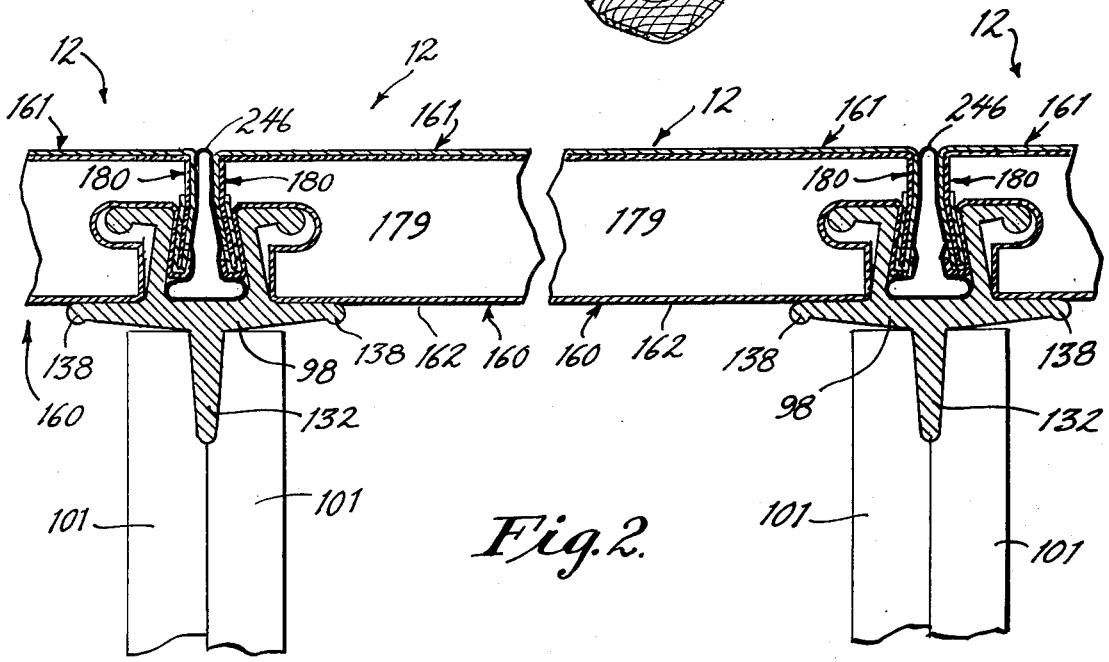
FIG. 2 is a sectional view taken along line 2—2 of FIG. 1.
Figure 3:
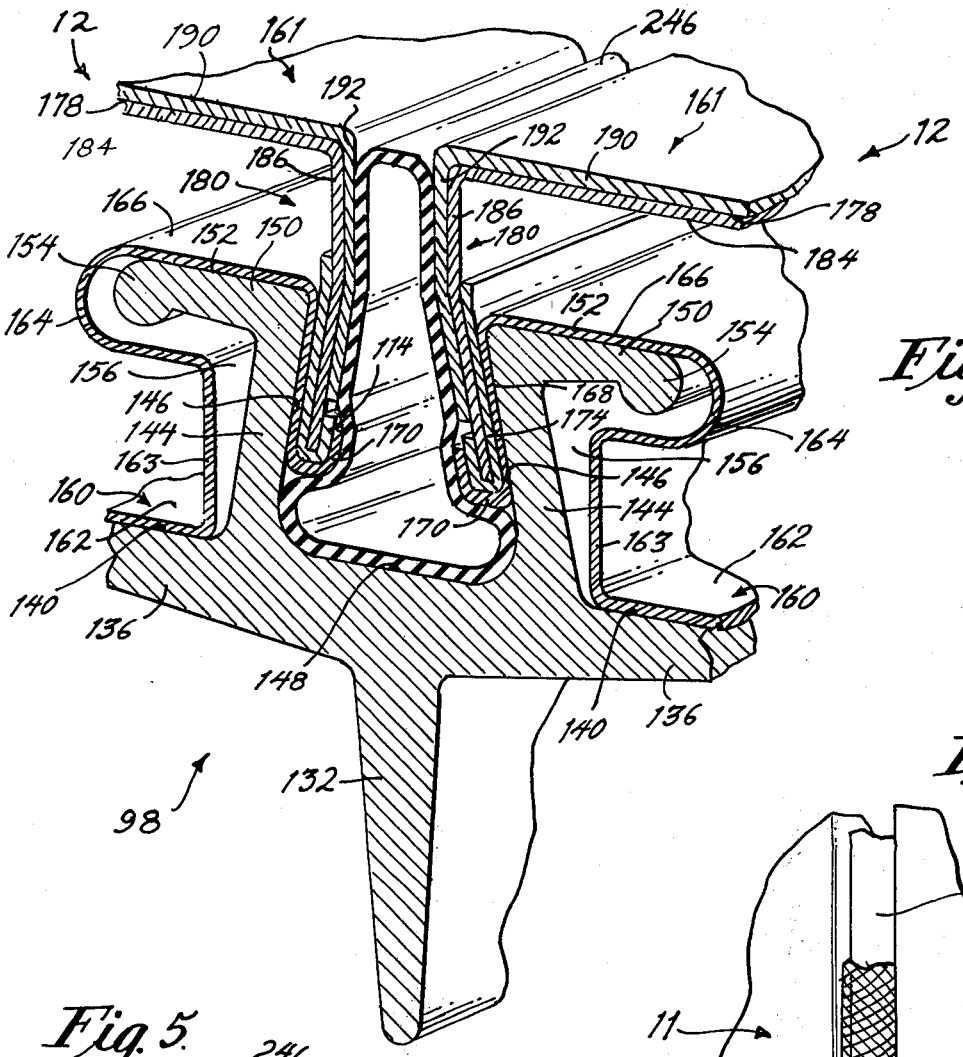
FIG. 3 is an enlarged view of a portion of the structure shown in FIG. 2.

As best seen in FIGS. 2 and 3, downwardly depending leg 132 supports two oppositely directed outwardly extending arms 136. Each of the arms 136 includes an enlarged bulbous portion 136 at its ends (FIG. 2). The upper surface 140 of each of the outwardly extending arms is substantially horizontal and functions as a support in a manner which will be described. Each of the aforementioned outwardly extending arms 136 supports an upwardly and inwardly directed leg 144 having an inwardly facing surface 146. The upwardly directed legs 144 are in spaced relation to eackh other. They are disposed on opposite sides of the aforementioned leg 132 so that a web 148 is defined therebetween. The relationship of the aforementioned legs 144 and web 148 may be considered to be a channel.

Each of the upwardly and inwardly directed legs 144 supports an outwardly extending upper arm 150 at its free end. The upper arms 150 comprise flat horizontal upper surfaces 152 which terminate in enlarged bulbous end portions 154. Each set of outwardly extending lower arms 136 and upper arms 150 define a generally C-shaped recess 156 therebetween.

WHile it is preferred that the entire framing member be prepared as a continuous extrusion with each of the elements defining its configuration extending for its entire length, it is apparent that the depending legs 132 may only be provided where it is necessary for them to be supported by a truss brace 101 or other member. Thus, a series of plates could be used. On the other hand, it should be noted that leg 132 increases the resistance of the upper elongated member to bending about its horizontal bending axis.

Thus, it is apparent that the upper elongated member explained in detail in FIGS. 2 and 3 has essentially the same cross section as that which is carried on the back wall of the outer column and illustrated in FIG. 11.

Because these joints have essentially the same cross section, the use of a module as a wall or a roof panel is made possible. Accordingly, such panels are illustrated in FIGS. 2, 3, 11 and 12. However, an explanation of the structure of these panels will be confined to FIGS. 2, 3 and 12. Each of the panels comprises an inner surface means 160 which defines the ceiling or inside wall of the collapsible building and an outer wall means 161 which may define the roof or the outside side walls of the structure.

Each of the inner surface means 160 is defined by a web 162 which will span between adjacent joints on the roof trusses or outer columns. At their edges, the webs 162 include convoluted web portions having generally upstanding L-shaped portions 163 which merge into curved elements 164 and flat faces 166. Each of the flat faces supports a downwardly and outwardly directed depending leg 168. At its lower edge, each of the depending legs includes a reverse bent support portion 170 which will be described herein in detail.

Thus, it can be seen that web 162 defines the inner surface of a wall or roof panel contemplated by this invention. It can also be seen that the L-shaped portions 163, the curved elements 164, the flat faces 166 and depending legs 168 define a channel for containing the leg 144 and arm 150 of a joint member 98. The cross sectional width of the downwardly facing opening of this channel is smaller than the remaining parts of the channel.

If desired a suitable elongated member 174 preferably comprised of thermal insulation material may be disposed within the reverse bent portion 170. Alternatively, the thermal insulation material may be bonded to an element as set forth below.

As seen generally in FIGS. 2 and 3 the outer wall means 161 comprises a web 178 adapted to be disposed in overlying spaced relation to aforementioned web 162 so that a space 179 is formed therebetween. That space may be left void and function as a dead air insulation zone or it may be filled with suitable insulation materials. The web 178 has a downwardly depending leg 180 at each of its ends to be received within the channels defined by the joints on the roof trusses and outer columns.

Upon closer inspection, web 178 is seen to be comprised of a lower web 184 with a downwardly and outwardly depending leg 186. That leg forms part of the convoluted web joining the inner surface means 160 and outer wall means 161 together and is received within the aforementioned reverse bent portion 170 of leg 168 and rests upon the strip of the insulation material 174. The insulating material may be adhesively bonded to leg 186 to simplify construction. It should be observed that leg 186 is relatively long with respect to leg 168 so that there is a substantial distance between the upper and lower webs.

Lower web 184 supports an upper web 190 which carries a depending leg 192. Upper and lower webs 184 and 190 are in close relation with each other as shown in FIG. 3. However, leg 192 does not come into contact with reverse bent portion 170.

Thus, the inner surface means 160 and the outer wall means 161 are thermally isolated from each other to the extent that there is no physical contact therebetween.

As explained above, the cross sections of the members defining the roof and side panels are identical. However, in longitudinal section they are distinct. Thus, as seen in FIG. 12, the side panels 11 are closed by upper and lower end caps 200. Each end cap is provided with gaskets 202 which may be elongated rectangular members positioned along that surface of the end cap adjacent web 178.

Each of the roof panels have end caps 208 and 210 which support mutually engaging latching means 212 and 214. Thus, latching means 212 comprises an outwardly directed and downwardly facing hook 216 while latching means 214 comprises an outwardly extending and upwardly facing hook 218. On the roof panels, the upper web 178 extends longitudinally beyond the end cap 210 to form a shingle 222. A gasket 224 is positioned below the shingle against end cap 210. The opposite end cap 208 is provided with an outwardly protruding rib 226. Thus, as can be seen in FIG. 12, the two hooks 216 and 218 engage each other so that adjacent roof panels, when disposed in end to end relation are held together. This relationship is augmented by the fact that gasket 224 is firmly engaged either by rib 226 on the adjacent end cap 208 or by the corner of the side panel. Thus, an effective seal is created between the adjacent roof panels and the roof panel and the side panel.

Obviously one long roof panel could be used instead of the two panels described.

A ridge cap assembly 232 is provided for the collapsible building. As seen in FIGS. 12 and 13 the ridge cap assembly 232 comprises a plurality of elongated "V" shaped members 234 which are placed in end to end relation along the ridge of the building and lie along the upper surfaces of the roof panels. The elongated members are supported by a plurality of first members 236 which have generally U-shaped legs 237 which are received in the channel portion of the roof trusses. The U-shaped legs 237 span the ridge of the building so that they are connected to the roof trusses on each side thereof. Attached to each of the legs 237 is a rectangular spacer 238. The spacers extend a short distance on both sides of the roof trusses along the ridge.

The elongated members 234 include downwardly directed ends 235 which are engageable over the ends of spacers 238. Thus, the elongated members can be pressed into locking position whereby they seal the ridge.

The entire building is assembled into a rigid unitary structure by the utilization of suitable expansion means which are received within the joints defined by the roof trusses, the outer columns, and the ridge cap assembly. These means may comprise wedges, spring like devices or other expansible members. However, it is preferred that expansible gaskets be used. As shown in FIGS. 2 and 3 a gasket 246, inflatable by either liquid or gaseous material, completely fills the void between facing legs 192 on the roof and side and urges them and their adjoining structural members into engagement with the upwardly and inwardly facing walls on the channel member.

Figure 4:
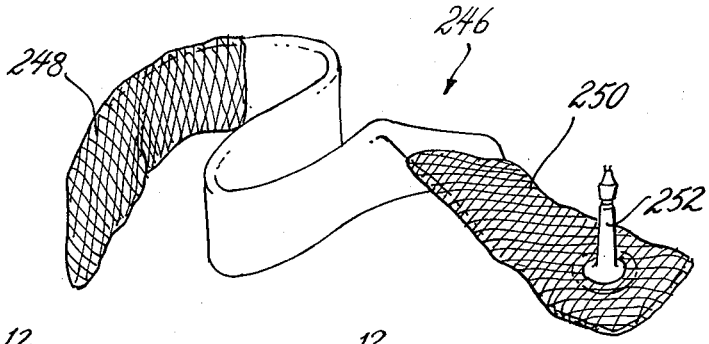
FIG. 4 is a detailed view of a gasket utilized in connection with the above-noted invention.

Referring now to FIG. 4, the gasket 236 is comprised of an elongated resilient air tight member having ends 248 and 250 reinforced with a suitable fabric. One of the ends may be provided with an enlarged bulbous protrusion which supports a suitable fluid inlet and outlet valve 252. As is apparent, the gasket is disposed in the space between the legs of the aforementioned webs. Upon its expansion, it locks the legs and webs attached thereto to the joint.

As shown in FIGS. 5 and 6, the gaskets are sufficiently long so that their enlarged bulbous protrusions will extend outwardly past the building line so that the valves may be inflated or deflated as the need requires. It is apparent that because of the shape of the space between adjacent webs, the gasket must be substantially deflated in order to remove it.

All of the elements described may comprise a kit for a collapsible building. In order to construct the building a foundation 14 is first prepared. The foundation is comprised of the separable members 16 described above. Each of the separable members is arranged so that a rectangular perimeter is defined. Corner foundation members, having L-shaped upstanding legs thereon are used to define the corners of the building.

Then, the outer columns 30 are erected along the perimeter at intervals designated by bolt holes in the foundation. The columns 30 are secured to the foundation by means of collars 48. The ends of the building and the sides thereof both utilize columns 30.

The inner columns 86 are disposed in generally linear array down what is to be the midportion of the building. As is apparent from an inspection of FIG. 7, there are substantially less columns 86 than there are columns 30.

The inner columns are connected along their free ends by a plurality of interconnection members 92. The interconnection members 92 are sufficiently long so that they span from the midpoint of the free end of one of the inner columns to the midpoint of the free end of the adjacent inner column.

The roof trusses are then mounted into position. As seen in FIG. 9, the outer portion of each truss has its outer reaction plate 112 supported by outer support surface 66 on the outer column. The hook 108 defining the truss latching means is received within the recess 120 defined by outer collar 118. The outer portion of the truss, along the ridge of the roof of the building, is supported on inner support surfaces 94 which are mounted at regular intervals along the connection members 92. At the juncture of adjacent interconnecting members a support surface 94 is bolted thereto. Thus, a plurality of support surfaces 94 are disposed along the central axis of the building at regular spaced intervals. The intervals correspond to the distance between adjacent outer columns 30. The inner portion of the roof trusses are supported by their reaction plates 110 bearing against the inner support surfaces 94. On those roof trusses which are aligned with an inner column 86, the inner hook 106 on the roof truss is connected to the recess 125 defined by collar 122 on the column.

Thus, when the trusses are bolted to the support plates, a rigid, unitary building frame is formed. The aforementioned side and roof panels are then mounted onto the side columns and roof trusses as shown in FIGS. 1, 2, 11 and 12.

Starting at a central portion of the building a first roof panel member is slidably mounted along the upwardly facing channel members defined by adjacent roof trusses by slipping its legs into the channel members at their ends adjacent the sides. Before the first roof panel is totally received within the perimeter of the building it is interconnected to a second roof panel by means of the aforementioned hooks 216 and 218. Thus, when the second roof panel is slid along the roof trusses, rib 226 pinches gasket 224 to form a tight seal. At the same time, shingle 222 also overlies the space between adjacent roof panels. Thus, a continuous roof section comprised of both panels is formed. In order to keep the panels from sliding off the trusses, a side panel such as described above, is slipped down into engagement with the channel members defined on two adjacent outer columns as shown in FIGS. 11 and 12. When the side panels are resting against the bottom of the foundation, their end caps 200 are in bearing contact with the gasket 224 on the end cap of the outermost roof panel while a gasket 202 on the end cap of the side members bears against shingle 222. The bottom end cap has a gasket that bears against the foundation. This process is repeated on the opposite set of trusses and columns on the other side of the building and the entire process is continued working outwardly from the center toward each end.

Panel members similar in construction to the roof and side panels described herein can be utilized in an identical manner to close off the end of walls of the building.

The ridge cap assembly is installed by placing first members 236 across the roof trusses FIG. 12 and then pressing the elongated members 234 over them. The U-shaped legs 237 serve as a gutter across the ridge.

After the building is assembled as described above suitable means are inserted between the legs of adjacent panels in order to lock them into close engagement with their respective columns or trusses. As indicated above, these means may include wedges or expansible means such as elongated inflatable gaskets or spring loaded devices. When the expansible means are installed and expanded, the building becomes a unitary structure of substantial strength.

Thus, a building comprising about 4,000 square feet may be assembled in approximately a day and a half. Such a building can be later knocked down to be reassembled elsewhere.

It should be noted that the particular elements and their manner of assembly results in a weather tight building. Thus, each of the roof and side panels is relatively thick with a substantial dead space therebetween. This has an effective insulating characteristic. Additionally, gaskets are provided along the junctures of all intersecting members. Finally, the expansible members and their relationship to the channels on the roof trusses and columns in which they are received results in effective sealing of the panels against the trusses while at the same time defining gutters so that water or any other precipitation can be easily shed. Significantly, there can be no entry of water or the like through the ridge cap because of its assembly.

The shingle on the roof panels also functions to facilitate the drainage of precipitation and protection of the interior of the building.

Thus, while the invention has been described with reference to one particular embodiment thereof it is apparent that many other forms and embodiments would be obvious to persons skilled in the art in view of the foregoing specification. Thus, the scope of the claims should not be limited thereby but rather only by the scope of the claims appended thereto.

I claim:

1. A surface construction comprising a panel, said panel comprising inner surface means and outer wall means, said inner surface means comprising a first web, said first web including opposed generally upstanding portions at its ends, said upstanding portions supporting substantially flat faces, each of said substantially flat faces supporting a downwardly directed leg the lower edge of which comprises a reverse bend, said outer wall means comprising a second web in overlying relation to said first web, opposed downwardly directed legs extending from said second web, said last named legs including a free edge which is received in said reverse bend, the distance between said second web and said free edge being large enough so that said first web and said substantially flat faces will be spaced from said second web to define an insulation zone therebetween.

2. A surface construction according to claim 1 wherein said panel includes means for insulating said downwardly directed legs of said inner surface means from said downwardly directed legs of said outer wall means, said insulating means comprising insulation material disposed in said reverse bend and lying between said legs where they are adjacently disposed.

3. A surface construction comprising a panel, said panel comprising inner surface means and outer wall means, said inner surface means comprising a first web including opposed generally upstanding portions at its ends, each of said upstanding portions supporting a downwardly directed leg, each of said legs being spaced apart from its supporting upstanding portion thereby defining a channel between each of said legs and its supporting upstanding portion, said channel having an opening communicating with the exterior of said panel, said outer wall means comprising a second web in overlying relation to said first web, opposed downwardly directed legs extending from said second web and each of said last named legs being secured to a different one of said first mentioned legs.

4. A surface construction according to claim 3 wherein said panel includes means for insulating said downwardly directed legs of said inner surface means from said downwardly directed legs of said outer wall means.

5. A surface construction according to claim 3 wherein the free end of each of said downwardly directed legs of said inner surface means is bent away from said channel.

6. A surface construction comprising a panel, said panel comprising inner surface means and outer wall means spaced from said inner surface means, said inner surface means and said outer wall means being joined together along two parallel edges thereof by a convoluted web means, said convoluted web means being comprised of a first portion connected to said inner surface means and a second portion connected to said outer surface means, said convoluted web means defining a channel having an opening facing downwardly and communicating with the exterior of said panel, the cross sectional width of said opening being smaller than the cross sectional width of at least part of the remaining parts of said channel.

7. A surface construction according to claim 6 wherein said panel includes means for insulating said first and second convoluted web portions from each other.

* * * * *